US005315942A

United States Patent [19]

Pantusco et al.

[11] Patent Number: 5,315,942

[45] Date of Patent: May 31, 1994

[54] HIGH SPEED SEWING MACHINE RUFFLER

[76] Inventors: Frank S. Pantusco; George E. Wiley, both of 5202-A Brook Hollow Pkwy., Norcross, Ga. 30071

[21] Appl. No.: 952,966

[22] Filed: Sep. 29, 1992

[51] Int. Cl.[5] ..... D05B 35/08

[52] U.S. Cl. ..... 112/134

[58] Field of Search ..... 112/132, 134, 135, 266.1, 112/414

[56] References Cited

U.S. PATENT DOCUMENTS

| | | | |
|---|---|---|---|
| 3,000,332 | 9/1961 | Sigoda | 112/132 |
| 3,014,444 | 12/1961 | Caldwell | 112/135 |
| 3,133,516 | 5/1964 | Gorin et al. | 112/132 |
| 4,108,094 | 8/1978 | Weigert | 112/134 |
| 4,364,317 | 12/1982 | Schneider et al. | 112/132 |
| 4,583,472 | 4/1986 | Johnson | 112/172 |
| 5,031,554 | 7/1991 | Glenn | 112/132 X |

FOREIGN PATENT DOCUMENTS

| | | | |
|---|---|---|---|
| 1460099 | 2/1989 | U.S.S.R. | 112/135 |

*Primary Examiner*—Clifford D. Crowder
*Assistant Examiner*—Ismael Izaguirre
*Attorney, Agent, or Firm*—James A. Hinkle

[57] ABSTRACT

A high speed sewing machine (15) ruffler (16) where the sewing machine output (26, 27) drives a belt (28) which operates a pair of shafts (24, 25) to move a ruffler pusher blade (46) at high speeds. The sewing machine output belt causes shaft (24) to oscillate by a drive lever (35), and causes shaft (25) to rotate by means of drive pulley (29). The oscillating shaft (24) rocks ruffler arm (45) to cause pusher blade (46) to move to and fro, while rotating shaft (25) causes an eccentrically mounted lift link (47), through connector (51), to lift the pusher blade from the material (53) upon the withdrawal stroke and to lower the pusher blade upon the feed stroke.

5 Claims, 5 Drawing Sheets

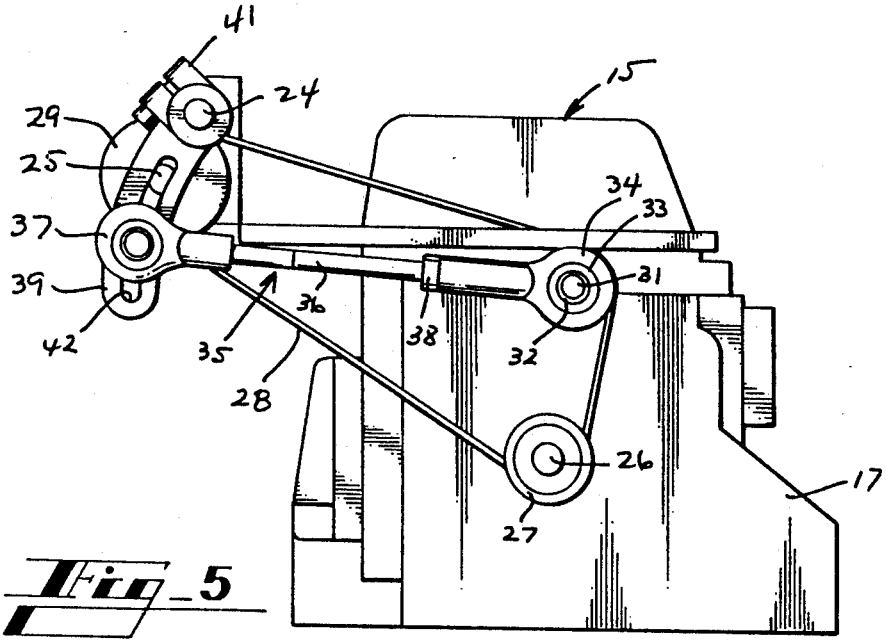
Fig_5
Fig_4
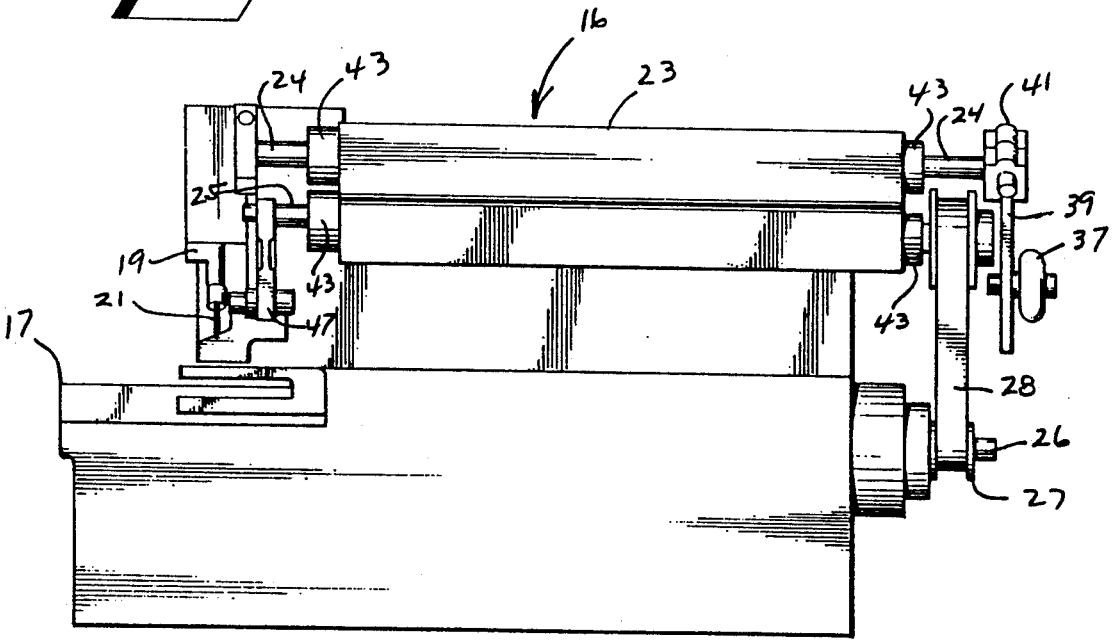

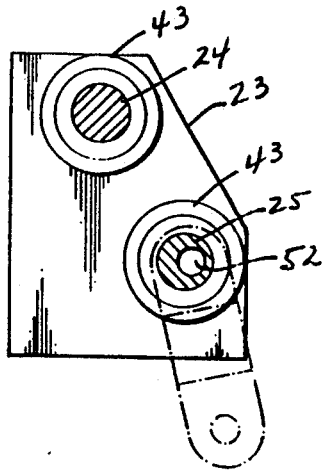
Fig_6
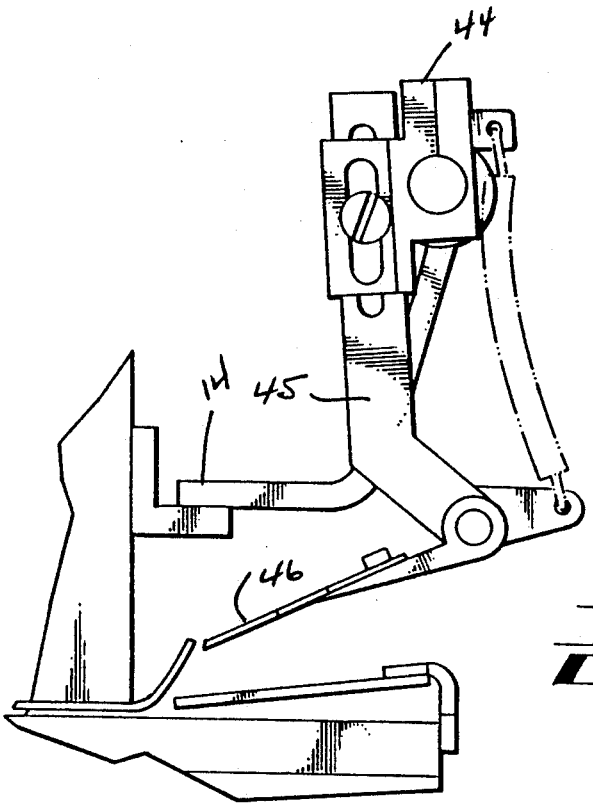
Fig_7
Fig_8
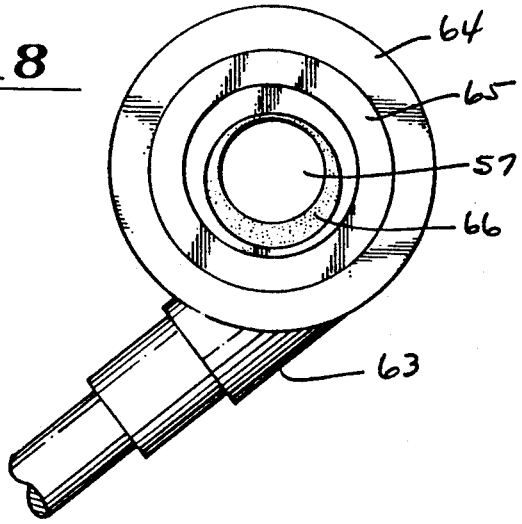

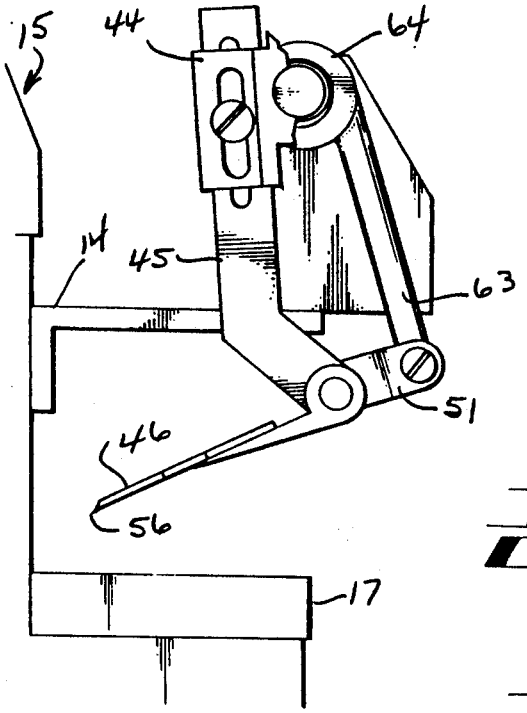
Fig_9
Fig_11
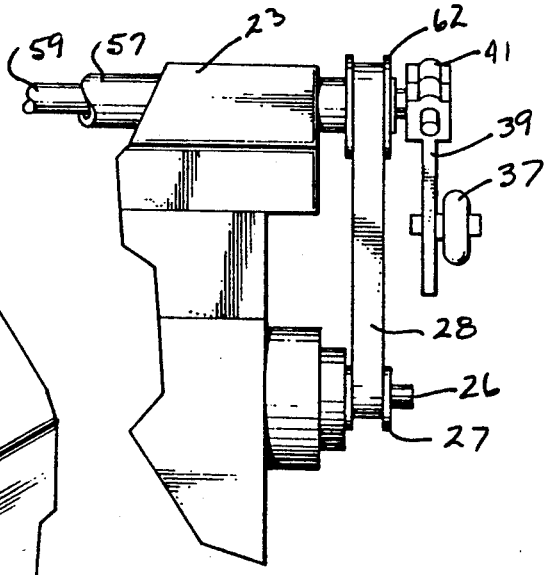
Fig_10
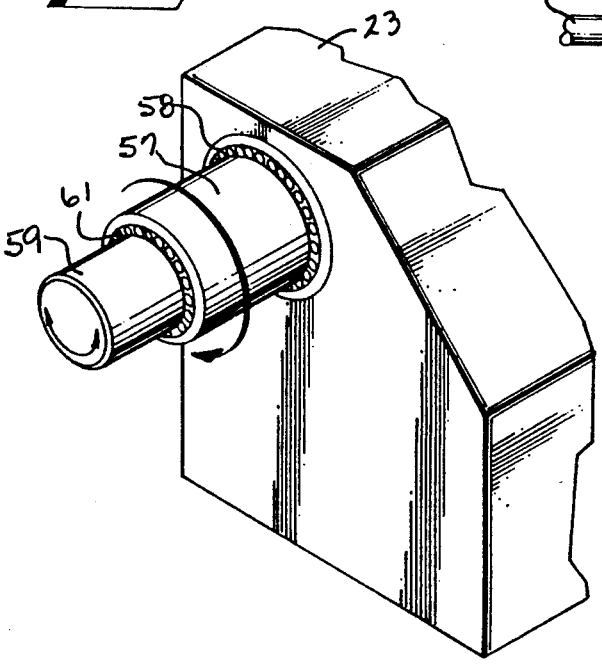

HIGH SPEED SEWING MACHINE RUFFLER

BACKGROUND OF THE INVENTION

I. Field of the Invention.

The present invention relates generally to the field of sewing machines and, more particularly, to a ruffling device that is particularly adapted to construct ruffles on dry goods such as curtains, dust ruffles, pillow shams, comforters and bedspreads.

II. Description of the Prior Art.

It is well known in the sewing art that ruffling machines are available to effect ruffling upon various dry goods. However, the prior art is plagued with ruffling devices which perform extremely inconsistent ruffling, wherein the ruffles are poorly spaced apart or are performed with one enough ruffle or too much ruffle. The result of prior art ruffling devices has been to manufacture ruffles on dry goods which are not particularly pleasing to the eye.

The typical art ruffler is, like the present invention, attached to a standard type sewing machine and operates in conjunction with the machine. The ruffler arm and blade assembly which gathers the material into the ruffle, is controlled generally by a spring which biases the ruffler pusher blade downwardly so that the blade is always in contact with the material to be ruffled. At high speeds the biasing spring cannot recover fast enough to disengage the ruffler pusher blade from the material to be ruffled to begin the next ruffling stroke. Therefore, when the ruffler blade retracts on the backstroke it invariably drags along the material to be ruffled thereby undoing the ruffle and giving an inconsistent appearance. At other times, the ruffler blade, because of the spring biasing, will push too much material into the sewing machine presser foot thereby giving a different type of inconsistent ruffle, one which shows too much gathering.

Due to the inability of a spring biased ruffler blade to recover on the ruffling stroke, the prior art machines have been limited in the speeds which they achieve during the ruffling process. The typical standard speed of the prior art machines are in the range of 2,500 to 3,000 ruffles per minute.

SUMMARY OF THE INVENTION

In accordance with the present invention, it is contemplated that a high speed ruffling device will be provided which incorporates a mechanical linkage between the drive mechanism of the ruffling apparatus and the ruffler blade wherein the stroke of the ruffler blade is precisely controlled on both the forward and backward strokes to effect a lifting of the ruffler blade from the material to be ruffled on the backstroke of the blade to effect an extremely consistent ruffle and to operate a extremely high speeds.

Therefore, the present invention provides a ruffling machine which will give consistent ruffles at high speeds of between 7,500 ruffles per minute and 9,000 ruffles per minute.

This invention further provides for a ruffling machine which will give even and precisely spaced ruffles at high speeds and wherein the ruffling machine can be regulated in its ruffling ability by simplified means upon the machine which can be easily adjusted to effect the desired ruffle.

Yet another object of the invention is the provision of an easily manufactured, relatively inexpensive high speed ruffling device which is readily adapted to a wide range of sewing machines to manufacture well sewn and consistent ruffles upon a variety of dry goods.

Other objects, advantages and capabilities of the invention will become apparent from the following description taken in conjunction with the accompanying drawings, showing preferred embodiments of the invention.

BRIEF DESCRIPTION OF THE DRAWINGS

FIG. 4 is a rear elevation view;

FIG. 5 is a right side elevation view;

FIG. 6 is a partial elevation view of the left side of the ruffling device showing the eccentric cam aperture of the rotating drive shaft for mounting the lift arm;

FIG. 7 is an elevation view of a typical ruffler arm of the prior art showing the spring biased mechanism;

FIG. 8 is a partial elevation end view of the drive mechanism of a second embodiment of the invention;

FIG. 9 is a more detailed left side elevation view of the ruffler arm drive mechanism of the embodiment of FIG. 8;

FIG. 10 is a perspective view of the single shaft assembly drive mechanism of the embodiment of FIG. 8; and FIG. 11 is a partial rear elevation view showing the right side of the ruffling device of the embodiment of FIG. 8.

DESCRIPTION OF THE PREFERRED EMBODIMENTS

Figure 1:
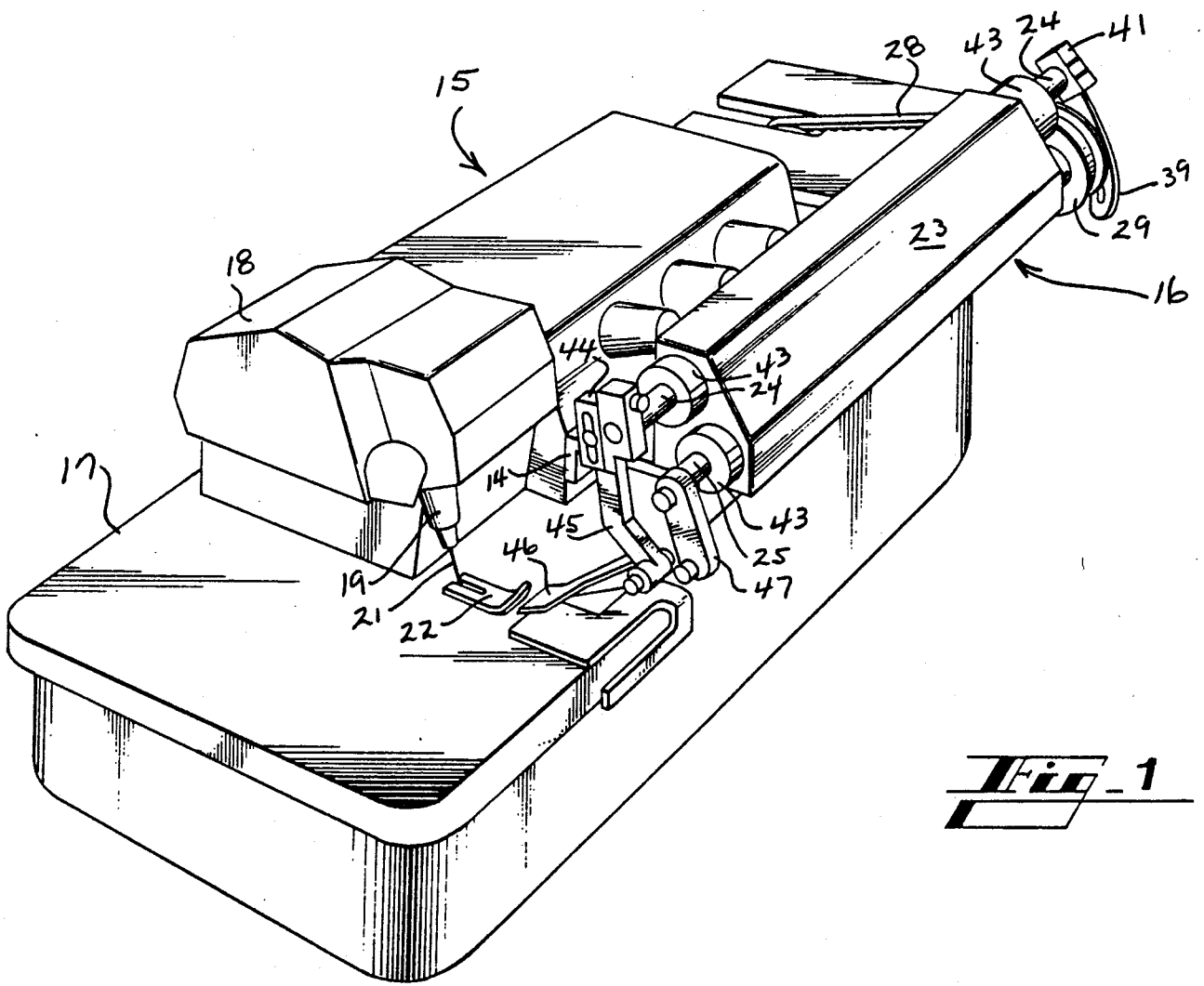
FIG. 1 is an overall perspective view of the present invention mounted upon a typical sewing machine.
Figure 2:
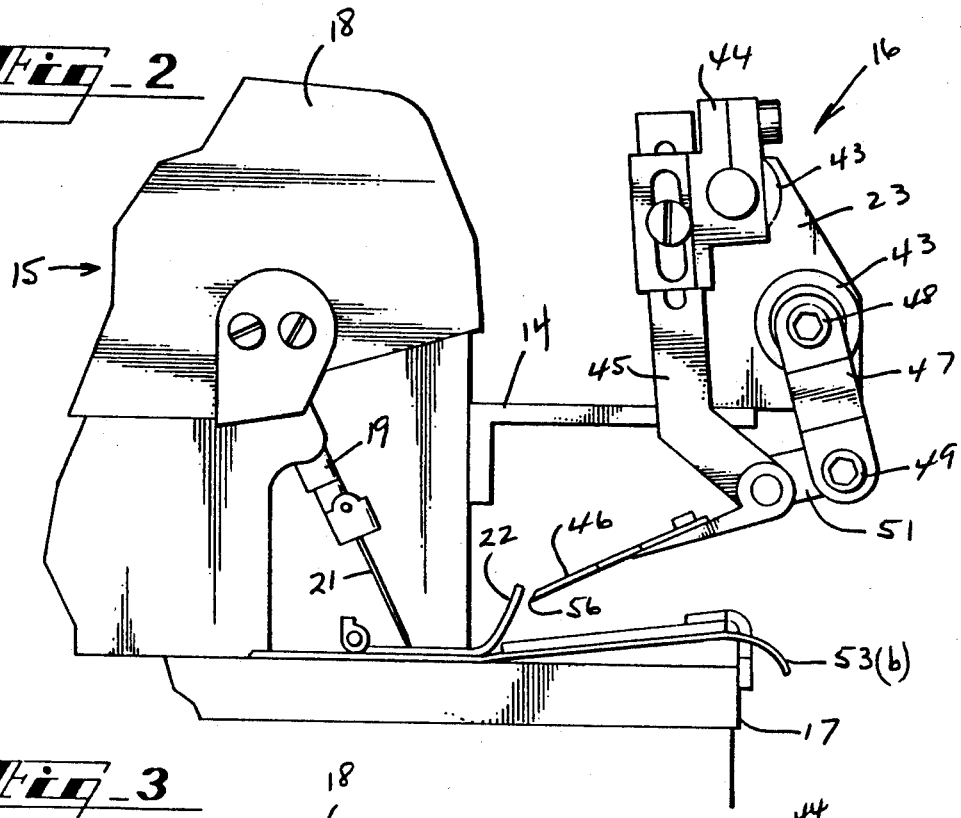
FIG. 2 is a left side elevation view of the ruffling device mounted upon a broken away view of the sewing machine, wherein the ruffler is shown with the ruffler blade in a retracted and withdrawing mode.

Referring to the drawings wherein like reference numerals designate corresponding parts throughout the several figures, and specifically referring to FIG. 1, there is shown a sewing machine generally indicated by numeral 15 which has attached to it the high speed ruffler of the present invention generally indicated by numeral 16 and mounted to the sewing machine by a standardized bracket assembly 14.

The sewing machine 15 does not indicate any particular brand of machine, but only shows the basic components of a typical machine which may well include a base 17 and a needle drive head 18 which reciprocates a needle holder 19 to effect movement of needle 21 with the material to be sewn. Typical of all sewing machines is the provision of a presser foot 22 which cooperates with the needle 21 and the material to be sewn to provide a downward bias to the material and to assist in feeding the material past the needle. In the present invention, the presser foot also assists in forming the ruffles by supplying sufficient downward pressure to the material to assist in the formation of the individual ruffles.

In the preferred embodiment, the high speed ruffler 16 comprises a shaft housing member 23 which encloses and supports the two main operating shafts of the ruffler, namely the oscillating shaft 24 and the rotating shaft 25.

Referring now especially to FIGS. 4 and 5, it can be seen that the sewing machine 15 provides an output shaft 26 and a drive pulley 27 which cooperate with a drive belt 28 for translation of power to the high speed ruffler 16. The drive belt 28 is looped around drive pulley 29. The pulley 29 is mounted upon the rotating shaft 25 to effect rotation of this shaft.

In addition, the drive belt 28 is looped around a drive pulley (not shown) which is connected to a shaft 31 mounted in the sewing machine. Shaft 31 has mounted to it an eccentric 32 cooperating with a bearing 33 which is mounted to the proximal end 34 of the adjustable length drive lever 35. The drive lever 35 has a lever arm 36 attached between the proximal end 34 and the distal end 37. The length of the drive lever 35 may be adjusted by means of the adjusting nut 38 which, when loosened, will allow the lever arm 36 to be rotated and adjusted for length. Once the arm 36 is of the correct length, the adjusting nut will be tightened against the proximal end fitting 34 to maintain the arm in its desired length. The drive lever 35 connects at its distal end 37 with a slotted actuator arm 39 which is in turn fixed to oscillating shaft 24 by means of the adjusting clamp 41. Not only is the drive lever 35 adjustable on length, but it may also be positioned within slot 42 of actuator arm 39 to give a range of adjustment which may be necessary to give the proper oscillating arc to shaft 24.

Figure 3:
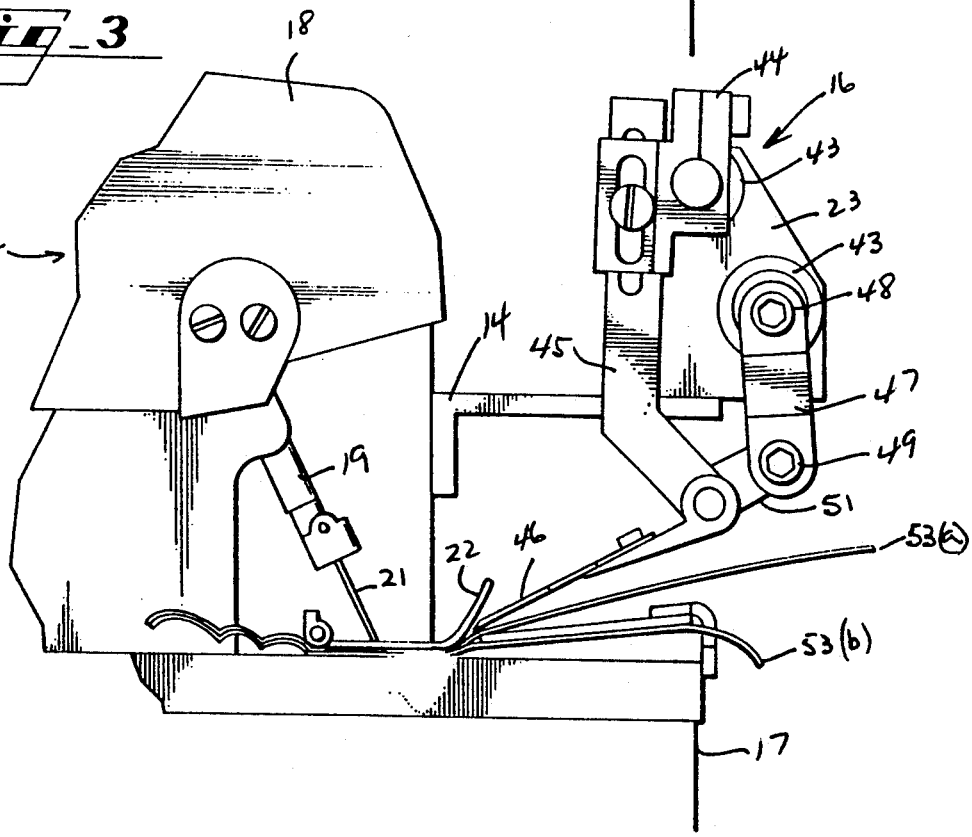
FIG. 3 is a left side elevation view similar to that of FIG. 2, however, showing the ruffler blade at the forward edge of the ruffle stroke and being prepared to be lifted for the backstroke.

The oscillating shaft 24 and the rotating shaft 25 are suitably mounted within the shaft housing 23 by means of respective bearings located in bearing housings 43. For convenience of descriptive purposes, the ends of shafts 24 and 25 which interact with drive belt 28 and the drive lever 35 may be identified as the proximal end, and the other end of the shafts which interact with the ruffling mechanism may be described as the distal end of the shafts. The ruffling mechanism is shown in detail in FIG. 3 and comprises an adjustable clamping and blade throw controller mechanism 41 affixed to the oscillating shaft 24, and holds the ruffler arm 45 in proper vertical position with respect to the attached ruffler pusher blade 46. Interconnected with the ruffler arm 45 and ruffler pusher blade 46 is lift link 47 which is attached by means of fastener 48 in an eccentric manner with respect to the center line of the distal end of rotating shaft 25. The other end of lift link 47 is attached by means of fastener 49 to link connector 51 which is in turn fastened to ruffler arm 45. The eccentric connection of lift link 47 to the distal end of rotating shaft 25 is specifically shown in FIG. 6 and, as illustrated, the distal end of shaft 25 has the fastener aperture 52 positioned eccentrically with the center line of the shaft so that upon rotation of shaft 25 the lift link 47, which is freely mounted to the distal end of the shaft, will move linearly a distance dictated by the eccentricity of the aperture 52.

In the operation of the ruffling device shown in FIGS. 1–6, the operator of the sewing machine will have previously inserted one or more pieces of dry goods material **53*a* and 53*b* under the presser foot 22 in order to begin the process. When the sewing machine 15 is energized, the power shaft 26 causes the drive belt 28 to move about the various drive pulleys to transfer rotative energy to those pulleys. This action will rotate the rotating shaft 25 which will deliver an output to the distal end of the shaft to the lift link 47 which is mounted eccentrically to the end of the shaft. This causes the upper end 54 of the lift link to move in a circular motion due to the effect of the eccentric mounting. The circle motion of the upper end of the lift link will then cause a linear motion of the lower end 55 of the lift link, which in turn transfers linear movement to the link connector 51 and subsequently to the ruffler pusher blade 46. Inasmuch as the pusher blade 46 is connected to ruffler arm 45, the blade 46 is linearly moved due to the oscillation of shaft 24**.

At the same time, the drive belt 28 is causing the adjustable length drive lever 35 to reciprocate linearly due to the eccentric mounting on shaft 31. This linear motion is transmitted to the distal end of lever 35 and causes the actuator arm 39 to move arcuately thereby oscillating shaft 24 within a limited range of motion required to impart the thrusting movement to ruffler arm 45 and consequently to the ruffler pusher blade 46. The combination of the movement of shafts 24 and 25, and ultimately ruffler arm 45 and lift link 47 causes the ruffler pusher blade to have a predetermined force and aft stroke wherein the tip 56 pushes against the material **53*a* and 53*b* during each stroke, but on the return portion of the stroke the pusher blade tip 56 is raised above the material and then lowered to the material once again at the end of the return stroke due to the vertical movement of lift link 47. The stitching of the ruffle going through the pressure foot is well known in the art and the result is that the individual ruffles are precisely spaced and stitched at a high rate of speed. Because tip 56 of the blade 46 does not contact the material 53*a* and 53*b*** on the return backward stroke, the stitching produces a significant improvement in the resulting ruffles.

Referring to FIGS. 8–11, it is anticipated that the same effect on constructing consistent ruffles may be achieved by combining shafts 24 and 25 into one unitary shaft structure as seen in these figures. Referring especially to FIG. 10 for the construction of the unitary shaft, it can be seen that the rotating shaft 57 is supported by bearing structure 58 in the shaft housing 23. Within the hollow rotating shaft 57, there is mounted oscillating shaft 59 within the bearing structure 61. To drive both shafts 57 and 59 there is shown an optional drive mechanism in FIG. 11 wherein the drive belt 28 rotates the rotating shaft 57 by engaging drive pulley 62. The movement of oscillating shaft 59 is accomplished in essentially the same manner as shown in FIG. 5.

At the distal end of the shaft housing 23 of this second embodiment, the lift link mechanism, as seen in FIG. 9, comprises a modified lift link 63 which has an enlarged hub 64 encircling a bearing structure 65 which encloses the eccentric structure 66 fitted about the circumference of rotating shaft 57.

It should be evident in this embodiment that when shaft 57 rotates the eccentric 66 causes the hub 64, and ultimately lift link 63, to move linearly to provide the linear motion to connecting link 51 to thereby operate the ruffler arm 45 and ruffler pusher blade 46 in the same manner as described for the first embodiment.

Various modifications may be made of the invention without departing from the scope thereof and it is desired, therefore, that only such limitations shall be placed thereon as are imposed by the prior art and which are set forth in the appended claims.

What is claimed is:

1. A high speed machine ruffler for operation in conjunction with a sewing machine for creating ruffles on dry goods material, wherein the sewing machine has power take-off means, sewing means and dry goods material guide means, the ruffler comprising:

means for mounting the ruffler to the sewing machine, power means for operating the ruffler wherein the power means comprises a plurality of drive shafts, the plurality of drive shafts comprising a first oscillating shaft and a second rotational shaft, each of said shafts having a proximal and a distal end, drive means interconnecting the power take-off means of the sewing machine with both the first and second shafts, wherein the said drive means provides rotational motion to the second shaft, an adjustable length lever, the drive means interconnecting the power take-off means of the sewing machine and the adjustable lever and the first shaft to provide oscillating motion to the first shaft, the adjustable length lever comprising a proximal end and a distal end, a shaft driven by the drive means having an eccentric output, the proximal end of the adjustable length lever being connected to the eccentric output to provide linear motion to the adjustable length lever, rotation producing means connecting the proximal end of the first shaft to the distal end of the adjustable length lever whereby the linear motion of the lever produces an oscillating rotational motion in the first shaft, means for receiving power input from the power take-off means of the sewing machine and transferring the power input to the power means for operating the ruffler, means for creating ruffles on dry goods material, the means for creating ruffles comprising a ruffler-pusher blade for selective contact with the dry goods material to form ruffles therein, motion producing means to cycle the ruffler pusher blade in a linear direction, said motion producing means comprising a ruffler arm interconnected between the pusher blade and the first drive shaft, and eccentric motion means to effect lifting of the pusher blade from the dry goods material at predetermined periods of the pusher blade motion cycle, said eccentric means to effect lifting of the pusher blade from the dry goods material comprising an eccentrically located pivot connecting point at the distal end of the second shaft, a first linkage means attached to the eccentrically located pivot point, a second linkage means attached to the first linkage means and further interconnecting the first linkage means to the ruffler arm, whereby the pusher-blade is reciprocated linearly by the ruffler arm and is lifted from the dry goods material at predetermined times by the first linkage means.

2. A high speed sewing machine ruffler as claimed in claim 1, wherein said eccentric means to effect lifting of the pusher blade from the dry goods material comprises the first oscillating shaft being mounted concentrically within the second rotational shaft and wherein each shaft moves independently of the other, an eccentrically mounted first linkage means mounted to the second shaft, a second linkage means attached to the first linkage means and further interconnecting the first linkage means to the ruffler arm, whereby when the pusher blade is reciprocated linearly by the ruffler arm and is lifted from the dry goods material at predetermined times by the first linkage means.

3. A high speed sewing machine ruffler as claimed in claim 1, wherein the first linkage means comprises an elongated bar having a proximal end and a distal end, the proximal end having an aperture therein through which a fastening means is positioned to secure the proximal end to the pivot connection point of the second shaft, the distal end having an aperture therein, fastening means connecting the distal end of the elongated bar to the second linkage means.

4. A high speed sewing machine ruffler as claimed in claim 3, wherein the second linkage means comprises an elongated bar having a proximal end and a distal end, the proximal end of the second linkage means elongated bar being connected for rotational movement with the distal end of the first linkage means, the distal end of the second linkage means being rotationally connected to the ruffler arm at a lower end portion thereof.

5. A high speed sewing machine ruffler as claimed in claim 4, wherein said ruffler arm comprises a proximal end adjustable rotatably connected to the first shaft, a distal end of the ruffler arm being rotatably connected to the second linkage means and to the ruffler pusher blade at a common connecting point, the common connecting point comprising an axle shaft to which the ruffler pusher blade is fixedly attached and to which the distal end of the ruffler arm and the distal end of the second linkage means are rotatably attached.

* * * * *